United States Patent [19]

Cheatham

[11] 4,035,878

[45] July 19, 1977

[54] APPARATUS FOR SMOOTHING THE SURFACES OF MOVING WEBS

[75] Inventor: Joseph F. Cheatham, Sudbury, Mass.

[73] Assignee: SW (Delaware), Inc., Providence, R.I.

[21] Appl. No.: 570,100

[22] Filed: Apr. 21, 1975

Related U.S. Application Data

[63] Continuation-in-part of Ser. No. 521,179, Nov. 6, 1974, abandoned, which is a continuation-in-part of Ser. No. 436,838, Jan. 28, 1974, abandoned, which is a continuation-in-part of Ser. No. 331,199, Feb. 9, 1973, abandoned.

[51] Int. Cl.[2] ..... D06C 3/00

[52] U.S. Cl. ..... 26/87; 38/143; 162/271; 226/196; 242/76

[58] Field of Search ..... 19/65 T, 66 T; 26/54, 26/59, 87, 101; 38/69, 100, 143; 162/197, 271; 226/196, 197; 242/76

[56] References Cited

U.S. PATENT DOCUMENTS

| | | | |
|---|---|---|---|
| 3,286,307 | 11/1966 | Watson | 19/66 T |
| 3,440,736 | 4/1969 | Fleissner et al. | 26/59 UX |
| 3,474,509 | 10/1969 | Bray | 26/54 X |
| 3,521,802 | 7/1970 | Bossons | 226/196 X |
| 3,698,039 | 10/1972 | Kalwaites | 19/66 T |

FOREIGN PATENT DOCUMENTS

| | | | |
|---|---|---|---|
| 1,258,313 | 1/1968 | Germany | 19/65 T |

*Primary Examiner*—Robert R. Mackey
*Attorney, Agent, or Firm*—Kenway & Jenney

[57] ABSTRACT

This invention provides an apparatus for removing wrinkles in a thin flexible moving web such as paper or textiles. The web is passed over a bar curved to effect a shear force on the web and/or a tensile force on the web in a direction perpendicular to the direction of movement of the web. The bar is oscillated resonantly or nonresonantly with one component of the oscillation being in a direction normal to the web surface so that its intermittent contact with the web causes any wrinkles therein to collapse. Gas, under super-atmospheric pressure can be passed through ports in the bar surface and into contact with the web to assist in collapsing wrinkles.

7 Claims, 7 Drawing Figures

APPARATUS FOR SMOOTHING THE SURFACES OF MOVING WEBS

REFERENCE TO RELATED APPLICATIONS

This application is a continuation-in-part of application Ser. No. 521,179, filed Nov. 6, 1974, now abandoned, which is a continuation-in-part of now-abandoned Ser. No. 436,838, filed Jan. 28, 1974, which in turn is a continuation-in-part of now-abandoned Ser. No. 331,199, filed Feb. 9, 1973.

BACKGROUND OF THE INVENTION

This invention relates to a curved bar apparatus for smoothing and guiding moving webs such as paper or textiles.

Moving webs such as paper or textiles are processed at relatively high speeds by passing them over and between rollers to and from various processing steps to which the web is subjected such as drying, printing, etc. During movement over the rollers, these webs have a tendency to form wrinkles or folds which are undesirable since non-uniform treatment of the wrinkled web surface will result. Presently, the most commonly employed means for smoothing the surface of a moving web is by passing the moving web over a bowed roller, the surface of which rotates about its central axis and wherein the bow is in a direction such that the central portion of the web is elevated above the ends of the web. This roller configuration applies a tensile force in the lateral direction of the web thereby stretching it and unfolding or collapsing any wrinkles therein. While this means is generally effective for its intended purpose, it has disadvantages primarily resulting from the high cost thereof. For example, the bowed rollers are constructed with a central bowed bar which is enclosed by a plurality of bearings around which bearings extends a rubber cylinder which also is bowed and which rotates in contact with the moving web. The bearings employed are expensive to produce and to maintain and therefore are undesirable. Furthermore, there is a friction force between the roller and web which results in undesirable wear of the roller surface.

SUMMARY OF THE INVENTION

The present invention provides a curved bar adapted to oscillate linearly or angularly in a direction such that one component of the oscillating bar is in a direction normal to the web surface. The bar is supported so that it is located in contact with or adjacent to the moving web. The bar typically has a curvature of between about 0.5 and 5 percent as measured by the height of the center of the bar above the end of the bar divided by the linear distance between the bar ends. The bar is oscillated resonantly or nonresonantly so that the ratio of the frequency of the disturbing force to the frequency of free vibration of the system is as low as about 0.5 and as high as about 1.5. In one embodiment, the bar is formed from a hollow cylinder having a web-treating surface with openings such as slots or ports extending through its surface and is provided with a means for introducing a gas at superatmospheric pressure into the bar interior and through the ports. This invention is useful for smoothing the surfaces of relatively thin flexible moving webs such as paper or textiles.

The invention thus provides a nonrotating curved bar that is driven back and forth in a direction normal to the web surface passing thereover, and pressured air or other gas exits through the bar to create an air stream between the bar and the web. The reciprocating movement of the bar preferably is at a resonance of the moving system, i.e. of the dynamic system which is driven by the reciprocating movement of the bar.

DESCRIPTION OF THE FIGURES

This invention will be more fully described with reference to the accompanying figures.

DESCRIPTION OF PREFERRED EMBODIMENTS

Figure 1:
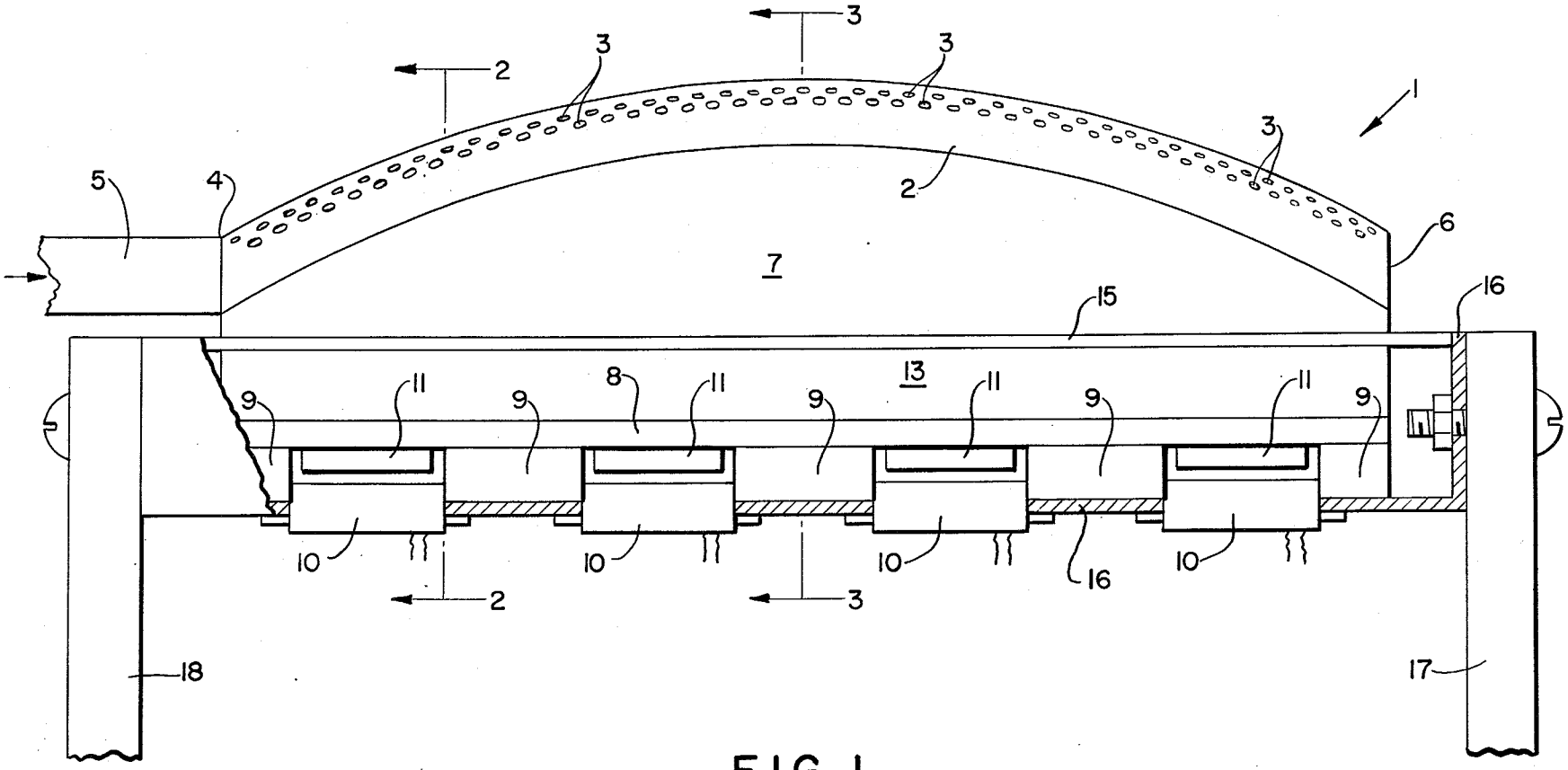
FIG. 1 is an elevated view, in partial cross section, of a curved bar of this invention.
Figure 2:
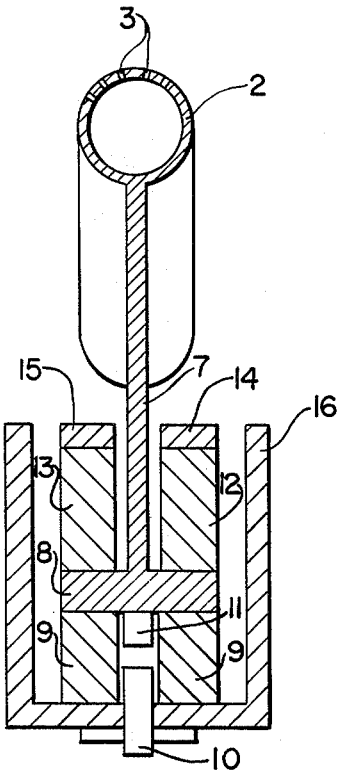
FIG. 2 is a cross-sectional view taken on line 2—2 of FIG. 1.
Figure 3:
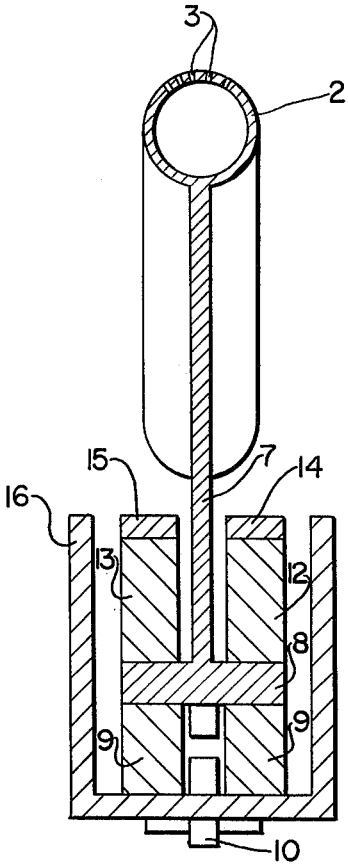
FIG. 3 is a cross-sectional view taken along line 3—3 of FIG. 1.

Referring to FIGS. 1 through 3, the illustrated oscillating bar 1 comprises a bowed hollow cylinder 2 having a plurality of ports or slots 3 therein connecting the interior of the cylinder to the outside atmosphere. The end 6 of the cylinder 2 is sealed and the end 4 of the cylinder 2 is connected to a conduit 5 which in turn is connected to a pump (not shown) adapted to supply gas under superatmospheric pressure into the cylinder 2. The cylinder 2 is supported by flange 7 and flange 8. Flange 8 rests upon flexible supports 9 made, for example, from rubber or other elastomeric material or structure and which extend along a sufficient portion of the length of the flange 8 to provide support for the flange 8 and cylinder 2. A plurality of electromagnets 10 are spaced apart along the length of and below the flange 8. Ferromagnetic masses 11 are attached to the bottom surface of the flange 8 and positioned above and adjacent to each electromagnet 10. Two flexible mountings 12 and 13 are attached to and extend along the length of the top surface of flange 8 and are located on either side of flange 7. The flexible mountings 12 and 13 are maintained under a slight compressive force by means of bars 14 and 15 which extend along the entire top surface of the flexible mountings 12 and 13. Bars 14 and 15 are fixed, at each end, to housing 16 so that they do not move during oscillation of cylinder 2. The housing 16 is fixed to supports 17 and 18 by any suitable means, preferably an adjustable means which permits adjusting the angle of contact of the cylinder 2 to a moving web which passes over the surface of cylinder 2.

In use, the amount and frequency of the power to the electromagnets are controlled so that the cylindrical bar 2, which functions somewhat like a nonrotating roller, will vibrate resonantly or nonresonantly and the electromagnets are operated from the same source so that they operate in unison. The bar is caused to vibrate resonantly or nonresonantly so that the ratio of the frequency of the disturbing force to the frequency of free vibration of the system is as low as about 0.5 or as high as about 1.5. The electromagnets alternately attract and repel the ferromagnetic masses 11 with the amplitude of vibration being controlled by the amount of power supplied to the electromagnets 10. The frequency and amplitude of vibration are controlled so that the surface velocity of the cylinder or bar 2 causes the wrinkles or folds in the moving web to become collapsed. Increased surface velocity can be obtained by increasing either the frequency or the amplitude of vibration. Generally, the amplitude of oscillation of the cylinder 2 can be varied between 0.005 and 0.10 inch at frequencies varying about 60 or 360 cycles per second although successful operation may be achieved in certain situations with other parameters. Wrinkle collapse in the moving web can be obtained either by oscillating the cylinder 2 or by effecting the oscillation in conjunction with passing gas under pressure from the cylinder interior through the ports 3 and into the web. Increased gas pressures increase the effectiveness of the oscillating cylinder to collapse wrinkles in the web.

It is preferred, however, that the bar be oscillated (reciprocated) and that the air or other gas be ejected from the bar into the web-bar interface space concurrently. The two phenomena, i.e. bar movement and a gas stream, appear to cooperate in collapsing wrinkles and other deformities in the web and hence in smoothing it. Resonant movement of the bar, i.e. at a resonant frequency of the dynamic system which the electromagnets drive and which includes the mass of the curved bar and its mounting structure, is preferred because, relative to nonresonant operation, it requires far less input electrical power to the driving electromagnets and it develops fewer wearing forces in the mechanism.

Figure 4:
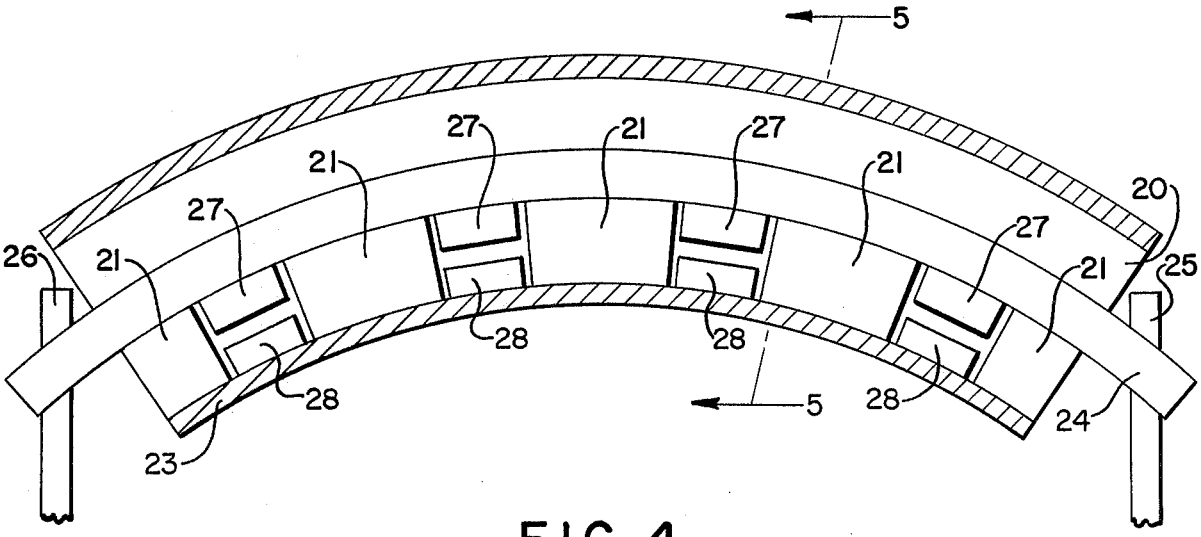
FIG. 4 is an elevated cross-sectional view of an alternative embodiment of this invention.
Figure 5:
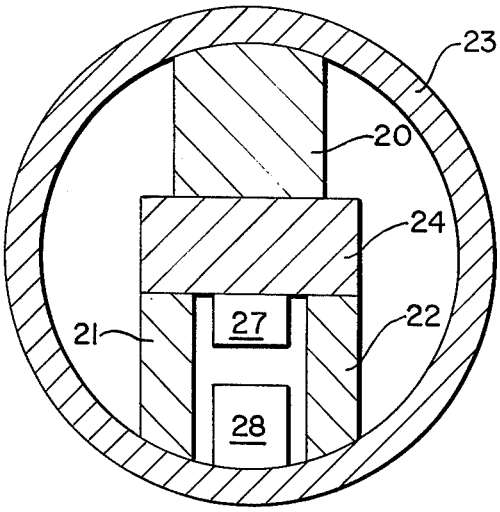
FIG. 5 is a cross-sectional view taken along line 5—5 of FIG. 4.

Referring to FIGS. 4 and 5, the embodiment shown therein is constructed so that the spring element is located within the oscillating cylinder rather than outside it. As shown, the spring element comprises rubber mountings 20, 21 and 22. The mountings 21 and 22 are the same size and extend along the oscillating cylinder 23 at the same positions. The mountings 20, 21 and 22 are attached to fixed bar 24 which in turn is fixed to supports 25 and 26. Ferromagnetic masses 27 are attached to the bottom of fixed bar 24 along spaced-apart intervals and are located above and adjacent to the electromagnets 28. The mountings 21 and 22 are spaced apart from the electromagnets 28 and the ferromagnetic masses 27 so that electrical leads for the electromagnets 28 can be passed therebetween into the cylinder 23 which is caused to oscillate about fixed bar 24 in the same manner as the construction described above. The construction shown in FIGS. 4 and 5 also can be provided with ports communicating the cylinder interior with the outside atmosphere with one end of the cylinder being sealed and the other connected to a source of pressurized gas.

Figure 6:
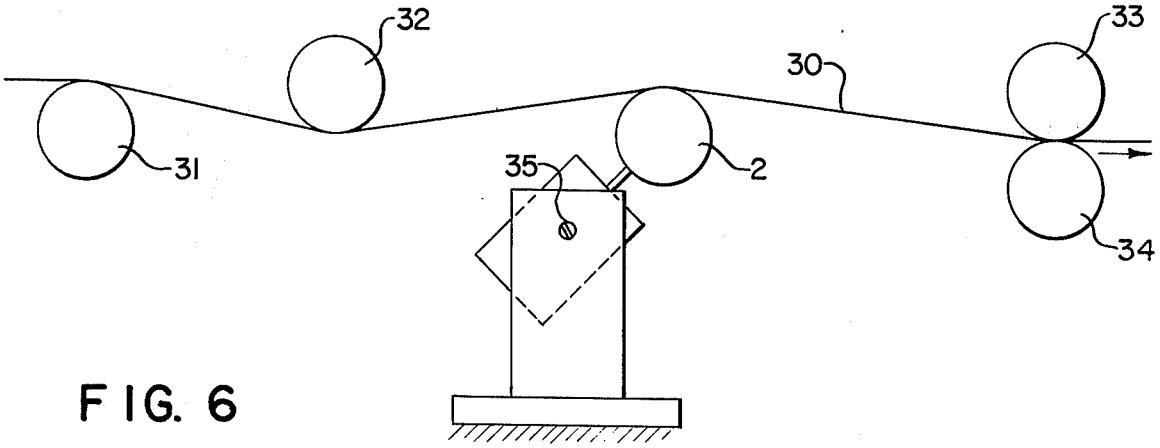
FIG. 6 is an elevational view of the bar of this invention in use.

Referring to FIG. 6, a web 30 is passed sequentially over roller 31 under roller 32 over oscillating cylinder 2 and between rollers 33 and 34. The angle of contact between moving web 30 and oscillating cylinder 2 can be adjusted by loosening the bolt 35, positioning the oscillating roller 2 at the desired angle, and thereafter tightening the bolt 35. Any wrinkles that are formed in web 30 by contacting rollers 31 and 32 are removed during contact with oscillating roller 2 so that the wrinkles are not permanently pressed into the web 30 when passed between rollers 33 and 34.

Figure 7:
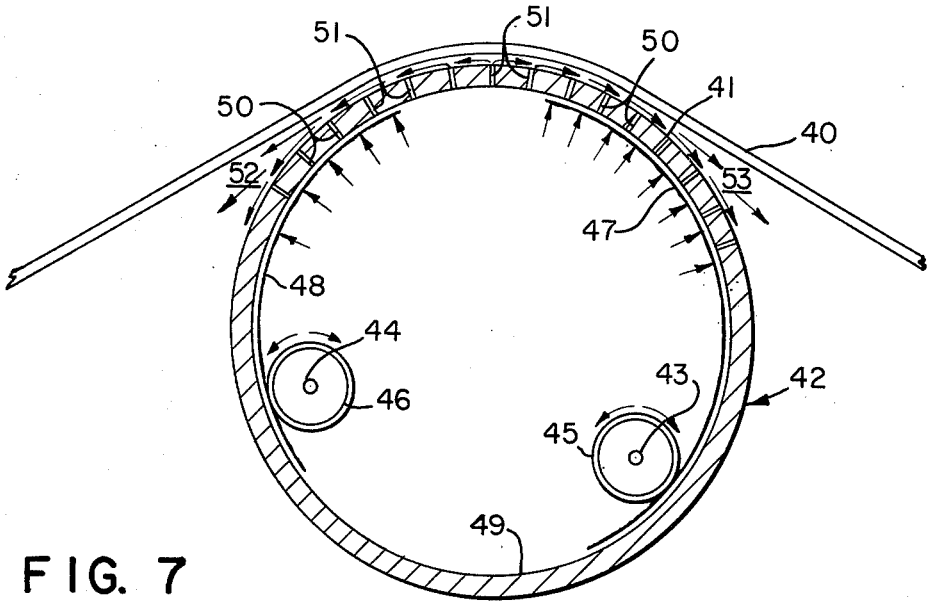
FIG. 7 is a side cross-sectional view of an apparatus of this invention with means for regulating gas flow.

An important aspect of the present invention will be discussed with reference to FIG. 7. The embodiment shown in FIG. 7 provides a means for maintaining a relatively stable gas cushion between the moving web 40 and the outer surface 41 of the reciprocating bar, i.e. oscillating cylinder 42. On each rod 43 and 44 are mounted a plurality of rollers 45 and 46. The rollers 45 and 46 are spaced apart along the length of each rod 43 and 44, which rods are bent to the contour of the cylinder 42. The ends of the rods 43 and 44 extend through end plates (not shown) of the cylinder 42 and are rotatable around an axis generally parallel to the main axis of the cylinder 42. Any means such as handles at one end of each rod 43 and 44 can be provided to rotate the rods. When the rods 43 and 44 are rotated, the rollers 45 and 46 also are rotated and, since they are in contact with semi-rigid plates 47 and 48, cause the plates 47 and 48 to move along the inside peripheral surface 49 of the cylinder 42. The plates 47 and 48 are shaped to conform to the general contour of the surface 49 and extend the length of cylinder 42. Thus the plates 47 and 48 can be positioned to selectively block some of ports 50 which extend through the cylinder 42 and to maintain the remaining ports 51 open to the atmosphere. When gas pressure is supplied to the interior of the cylinder 42, the plates 47 and 48 are pressed against the adjacent ports 50 to form a seal between the ports 50 and the interior of the cylinder 42. The number of ports selectively closed will depend upon the angle of contact between the web 40 and cylinder 42.

In operation, the embodiment shown in FIG. 7 provides a relatively stable air cushion between the moving web 40 and the surface 41. Gas is exited from the interior of the cylinder 42 through ports 51 but not through ports 50 by virtue of gas pressure provided within cylinder 42. The exited gas increases the gas pressure between the moving web 40 and surface 41 and when the web is relatively gas impermeable, the gas proceeds toward the open areas 52 and 53 between the web 40 and surface 41. As the gas proceeds toward openings 52 and 53, its pressure is reduced so that there is relatively slow exit of gas from the area between the web 40 and surface 41. In this manner, the desired gas cushion is maintained while requiring only relatively low gas pressures within cylinder 42 in the order of less than 20 psig. and in most cases about 5 psig. This embodiment provides substantial advantages in that lower gas pressures and less gas mass flow are required so that when the gas must be cleaned or dehumidified prior to contact with the web, less cleaning or dehumidification capacity is needed.

It is to be understood that the means for selectively closing the ports in the cylinder shown in FIG. 7 is merely illustrative and any conventional means can be used.

The web-treating surface of the oscillating bar in contact with the moving web should have a curvature of between about 0.5 % (or even 0.1%) and 5% so that the moving web, during contact with the bar, is subjected to a tensile and/or shear force in a direction perpendicular to the direction of movement of the web. This force togehter with the force generated by the movement of the bar effectively collapse any wrinkles in the web. It has been found that the force generated by the gas exiting from the ports in the bar into the moving web is insufficient to smooth the web but that oscillation of the bar alone is sufficient to smooth the web. However, it has been found that by employing the moving gas in conjunction with the oscillating bar effects improved results as compared with using the oscillating bar alone.

While the present invention has been described above with reference to the use of electromagnets to obtain the desired oscillation, it is to be understood that any mechanical, pneumatic or electromechanical means can be employed to obtain oscillation. For example, the flange 7 or the housing 16 (FIGS. 1-3) could be attached to a driven cam mechanism or to a reciprocating pneumatic means to obtain the desired oscillation. Furthermore, any spring means other than rubber mountings can be employed such as metal springs. The rubber mountings can be intermittent or continuous throughout the length of the oscillating bar 2. In addition bars 14 and 15 can be intermittent or continuous throughout the length of the oscillating bar 2, and, when intermittent can be fixed by any suitable means such as being bolted to housing 16 which bolts can extend through the rubber mountings and through a clearance hole in flange 8. If desired, electromagnets 28 can be attached to the fixed bar 24 while the ferromagnetic masses are attached to the oscillating curved bar.

It will thus be seen that the objects set forth above, among those made apparent from the preceding description, are efficiently attained. The curved and gas-cushioning reciprocating bar of the invention does not rotate and hence is free of bearing problems and other deficiencies of prior rotating apparatus. Moreover, the equipment of the invention provides successful web-smoothing operation and operates with efficient power consumption due to the resonant motion and optimized air cushion features. Since certain changes may be made in the above construction without departing from the scope of the invention, it is intended that all matter contained in the above description or shown in the accompanying drawings shall be interpreted as illustrative and not in a limiting sense.

Having described the invention, what is claimed as new and secured by Letters Patent is:

1. Apparatus for smoothing the surface of a moving web comprising a curved hollow bar having a web-treating surface, the web-treating surface of said bar having a plurality of ports communicating with the interior of said bar, said web-treating surface having a curvature between about 0.1% and 5% as measured by the height of the center of the bar above the ends of the bar divided by the linear distance between the bar ends, support means for said bar adapted to maintain the bar adjacent to or in contact with a moving web, means for introducing a gas at superatmosheric pressure into the interior of said bar and through said ports, means for selectively closing a portion of said ports to form a stable gas cushion between said bar and said moving web and means for oscillating said bar in a direction such that a component of oscillation is normal to the surface of said web.

2. The apparatus of claim 1 wherein the means for oscillating said bar comprises at least one electromagnet positioned to alternately attract and repel said bar.

3. The apparatus of claim 1 wherein the means for oscillating said bar comprises a plurality of electromagnets positioned to alternately and synchronously attract and repel said bar.

4. Apparatus for smoothing the surface of a moving web comprising a curved hollow bar, the surface of said bar having a plurality of ports communicating with the interior of said bar, said bar having a curvature as measured by the height of the center of the bar above the ends of the bar divided by the linear distance between the bar ends, support means for said bar adapted to maintain the bar adjacent to or in contact with a moving web, means for introducing a gas at superatmospheric pressure into the interior of said bar for exiting through said ports to pass between said bar and said moving web, and means for moving said bar back and forth in a direction such that a component of motion is normal to the web.

5. Apparatus as defined in claim 4 further characterized in that said means for moving said bar includes means for moving the bar in the direction normal to the web at a resonant frequency.

6. Apparatus as defined in claim 4 further characterized in that said means for moving said bar includes means for oscillating the bar at a resonant frequency of the bar and the mass moving therewith.

7. Apparatus for smoothing the surface of a moving web comprising a hollow bar curved to have a curvature as measured by the height of the center of the bar above the ends of the bar divided by the linear distance between the bar ends, a plurality of ports communicating between the outwardly curved surface of said bar and the interior of said bar, support means for said bar adapted to maintain the bar adjacent to or in contact with a moving web, means for introducing a gas at superatmospheric pressure into the interior of said bar for exiting through said ports to form a gas cushion between said bar and said moving web, and means for resonantly reciprocating said bar in a direction normal to the web.

* * * * *

UNITED STATES PATENT AND TRADEMARK OFFICE

CERTIFICATE OF CORRECTION

PATENT NO. : 4,035,878

DATED : July 19, 1977

INVENTOR(S) : Joseph F. Cheatham

It is certified that error appears in the above-identified patent and that said Letters Patent are hereby corrected as shown below:

Column 2, line 62 after the word "same" add --power--

Column 4, line 59 change "togehter" to --together--

Column 6, line 13 et seq. claim 4 should read

4. Apparatus for smoothing the surface of a moving web comprising a curved hollow bar having a web-treating surface, the web-treating surface of said bar having a plurality of ports communicating with the interior of said bar, said web-treating surface having a curvature between 0.1% and 5% as measured by the height of the center of the bar above the ends of the bar divided by the linear distance between the bar ends, support means for said bar adapted to maintain the bar adjacent to a moving web, means for introducing a gas at superatmospheric pressure into the interior of said bar for exiting through said ports to pass between said bar and said moving web, and means for moving said bar back and forth in a direction such that a component of motion is normal to the web.

UNITED STATES PATENT AND TRADEMARK OFFICE

CERTIFICATE OF CORRECTION

PATENT NO. : 4,035,878

DATED : July 19, 1977

INVENTOR(S) : Joseph F. Cheatham

It is certified that error appears in the above-identified patent and that said Letters Patent are hereby corrected as shown below:

Column 6, line 35 et seq. claim 7 should read:

7. Apparatus for smoothing the surface of a moving web comprising a hollow bar having a web-treating surface, the web-treating surface having a curvature between 0.1% and 5% as measured by the height of the center of the bar above the ends of the bar divided by the linear distance between the bar ends, a plurality of ports communicating between the outwardly curved web-treating surface of said bar and the interior of said bar, support means for said bar adapted to maintain the bar adjacent to a moving web, means for introducing a gas at superatmospheric pressure into the interior of said bar for exiting through said ports to form a gas cushion between said bar and said moving web, means for adjustably selecting the ports through which gas exits from said bar, and means for resonantly reciprocating said bar in a direction normal to the web.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*